United States Patent [19]

Jeans

[11] Patent Number: 4,562,013

[45] Date of Patent: Dec. 31, 1985

[54] CARBONATOR VALVE

[75] Inventor: Edward L. Jeans, Gwent, Wales

[73] Assignee: Cadbury Schweppes, PLC, London, United Kingdom

[21] Appl. No.: 550,454

[22] Filed: Nov. 10, 1983

[51] Int. Cl.[4] ..... B01F 3/04

[52] U.S. Cl. ..... 261/50 B; 99/323.1; 137/516.11; 222/145; 251/337; 261/52; 261/121 R; 261/DIG. 7

[58] Field of Search ..... 261/52, 64 R, 65, 121 R, 261/50 B, DIG. 7; 251/337, 339–341; 426/474, 477; 99/323.1; 222/129.1, 145; 137/209–211, 458, 516.11

[56] References Cited

U.S. PATENT DOCUMENTS

| | | | |
|---|---|---|---|
| 967,286 | 8/1910 | Young | 261/DIG. 7 |
| 2,226,958 | 12/1940 | Zahm et al. | 261/DIG. 7 |
| 2,241,018 | 5/1941 | Lloyd | 261/DIG. 7 |
| 3,752,452 | 8/1973 | Iannelli | 261/52 |
| 3,851,797 | 12/1974 | Jacobs | 261/DIG. 7 |
| 4,187,262 | 2/1980 | Fessler et al. | 261/DIG. 7 |
| 4,304,736 | 12/1981 | McMillin et al. | 261/DIG. 7 |

*Primary Examiner*—Richard L. Chiesa
*Attorney, Agent, or Firm*—Kenyon & Kenyon

[57] ABSTRACT

In a drink dispenser for dispensing carbonated drinks which includes a source of carbon dioxide at high pressure and a source of carbon dioxide at a lower pressure, the lower pressure being a pressure utilized for dispensing carbonated water, water within a carbonator tank is quickly carbonated by admitting carbon dioxide to the carbonator at the higher pressure until a pressure intermediate the higher and lower pressure is reached, venting the head space of the carbonator to the lower pressure, and, preferably, of repeating these steps a plurality of times.

10 Claims, 3 Drawing Figures

CARBONATOR VALVE

BACKGROUND OF THE INVENTION

This invention relates to soft drink dispensers, in general, and more particularly, to an improved carbonator valve for use in soft drink dispensers.

In the making of soft drinks, it is necessary that carbonated water be produced. Various types of carbonators have been developed. For example, in my co-pending application Ser. No. 393,298 there is a carbonator which admits carbon dioxide through a diffuser into a tank which has been filled with water. This type of carbonation works quite well. However, it takes a relatively long time for the water to be fully carbonated. It is possible to carbonate more quickly by using high pressures. This, however, creates problems with respect to dispensing and can cause an undesirable build-up of pressure.

There is thus, a need to carbonate quickly in a simple manner which can be carried out by a user of an in-home drink dispenser, for example, so that when a new batch of carbonated water must be made, it can be done quickly.

SUMMARY OF THE INVENTION

The present invention provides an improved method and apparatus for quickly carbonating a batch of water for use in a soft drink dispenser, particularly an in-home soft drink dispenser. In accordance with the present invention, this is accomplished by admitting carbon dioxide to the carbonator at a high pressure, of up to 1200 pounds per square inch, limiting the pressure within the carbonator during carbonating to approximately 175 psi and, upon completion of carbonating venting to 40 psi. Preferably, this is accomplished by means of a push-button valve, spring biased to a position where it vents to 40 psi, which valve is pressed until pressure builds up to cause operation of a 175 psi relief valve. Once this occurs, the push-button valve is released and the carbonator is automatically vented to less than 40 psi. To attain complete carbonation the steps of pressing and releasing are repeated a number of times.

DETAILED DESCRIPTION

Figure 1:
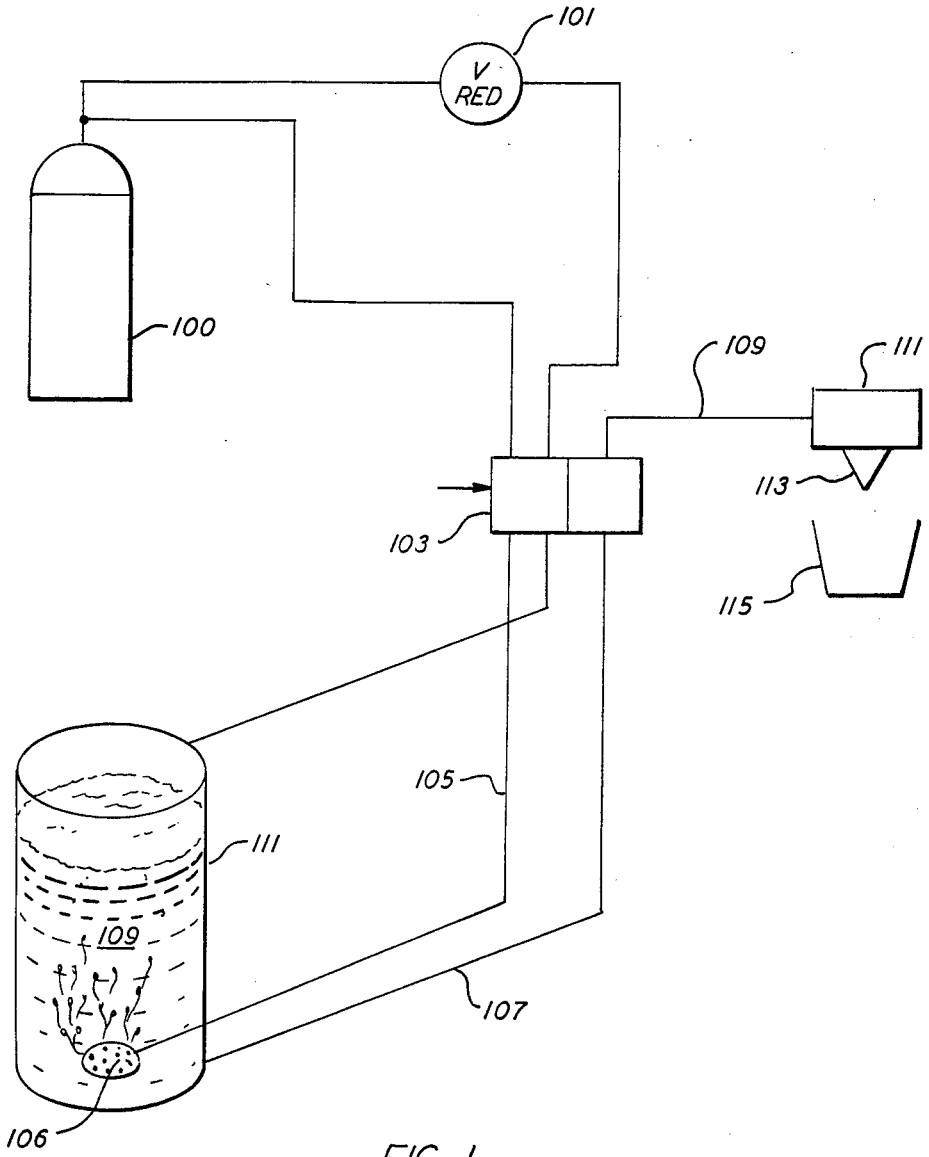
FIG. 1 is a block diagram of a system using the carbonator valve of the present invention.

FIG. 1 is an overall block diagram of the system of the present invention. A source of carbon dioxide 100, e.g., a carbon dioxide cylinder containing carbon dioxide at a higher pressure of, for example, 800 to 1200 psi is provided. This carbon dioxide is supplied to a reducing valve 101 which reduces the pressure to approximately 40 psi. The reduced pressure carbon dioxide and higher pressure dioxide are both provided to a valve 103 according to the present invention which is described in more detail in FIGS. 2 and 3. The higher pressure gas can be provided over a line 105, when the valve 103 is operated, to a sparger 106 from which it is admitted to the water 109 within the carbonator tank 111. The head space of the carbonator tank is coupled to the valve 103 and in an unoperated position valve 103 is in communication with the reducing valve 101. In addition, the carbonated water outlet line 107 from the carbonator tank 111 is coupled through valve 103 to a line 109 which runs to the manifold 111 to which the dispensing valve 113 is coupled to dispense carbonated water, possibly with a concentrate, into a glass or cup 115.

Figure 2:
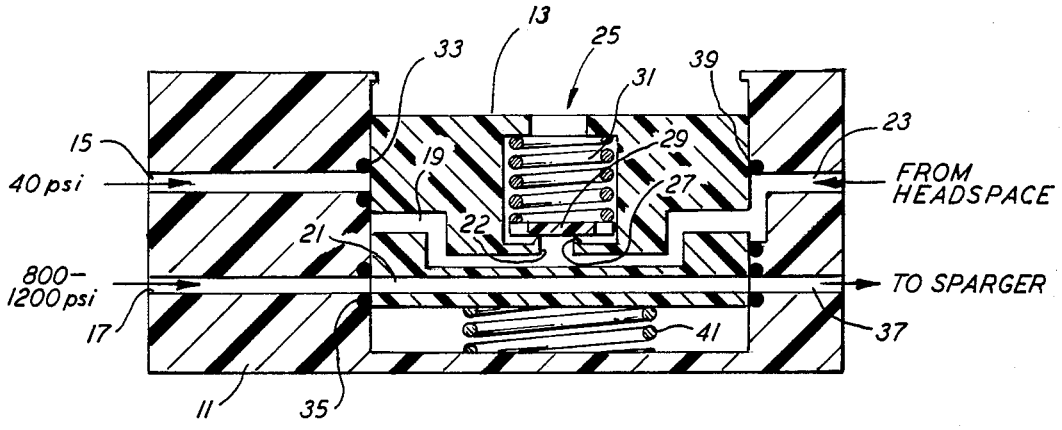
FIG. 2 is a cross-sectional view of a first embodiment of the carbonator valve of the present invention.

FIG. 2 is a cross-sectional view of a first embodiment of carbonating valve according to the present invention; the valve contains two major parts, a valve body 11 and a valve mechanism 13 in the form of a plunger. The valve body 11 contains a first passage 15 connected to a supply of carbon dioxide regulated to 40 psi, and the second passage 17 to a source of carbon dioxide at a pressure of between 800 and 1200 psi. The valve mechanism 13 similarly contains a passage 19 for carrying gas at 40 psi and a passage 21 for carrying gas at 800 psi. Passage 19 is joined to passage 22 which is connected to a 175 psi relief valve 25 formed by means of a valve seat 27 against which a valve disc 29 is biased by a spring 31 in conventional fashion.

In the position shown in FIG. 2, the plunger 13 is pushed downwardly so that the passage 17 is opposite passage 21. Sealing is accomplished by means of O-rings 33 and 35. Gas flows at high pressure through the passage 21 to an outlet passage 37 formed in the body 11, leading to the carbonator. This passage is sealed by an O-ring 39. As long as the plunger 13 is pushed downwardly against the force of a biasing spring 41, this connection exists. A passage 23 from the carbonator head space is coupled to passage 19. Passage 19 always remains coupled to passage 23 in this embodiment. When the pressure builds up to 175 psi, the relief valve 25 will operate. At this point, pressure should be released from the plunger 13 to allow the biasing spring 41 to return it to its outer position. In this position, the passage 19 is also aligned with the passage 15. Now, the 175 psi pressure within the carbonator is vented to 40 psi through the regulator valve 101 of FIG. 1 which is of the self-venting type. The process can be repeated a number of times to reach desired level of carbonation. Each time the pressure is reduced to 40 psi upon completion of carbonating, this pressure is maintained during the dispensing cycle until once again, the carbonator is refilled and carbonation again takes place.

Figure 3:
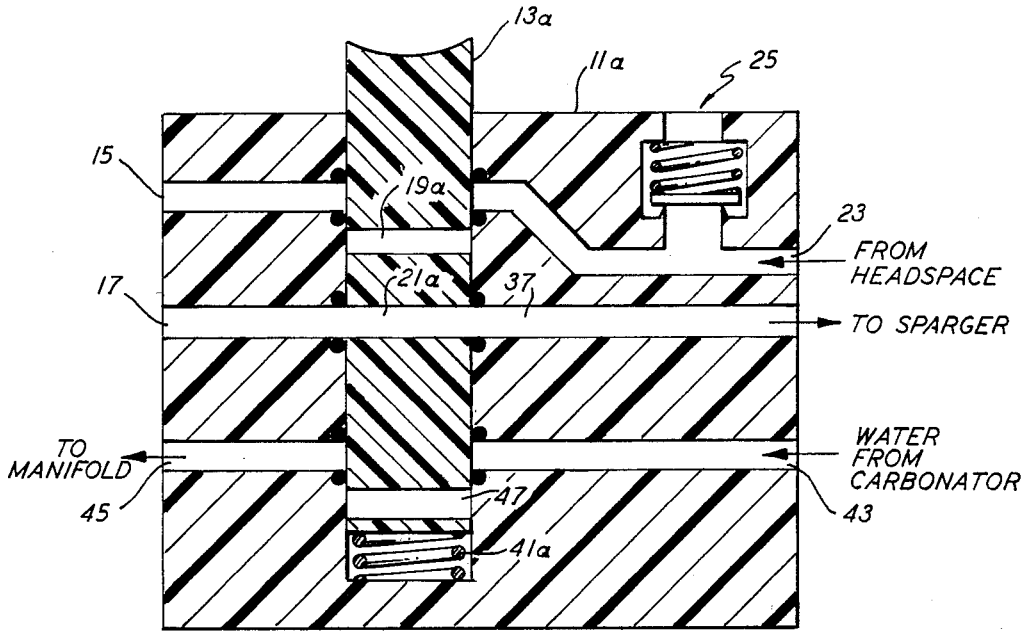
FIG. 3 is a similar view of a second embodiment of the carbonator valve of the present invention

An alternate form of valving mechanism is shown in FIG. 3. Here, in a body **11*a* an appropriate bore is formed and a push-button actuator or plunger 13*a* two passages 19*a* and 21*a* provided. The passages 15 and 17 are as before. Again, on the other side of the body are passages 23 and 37. The relief valve 25 now, however, is in the body 11*a*. In this embodiment, pressing the actuating plunger 13*a* inwardly against the force of spring 41*a* causes passage 21*a* to bring passage 17 into communication with passage 37 to allow the high pressure gas to enter the carbonator to carry out carbonation. Again, a 175 psi relief valve 25 is provided. In the outer position of the actuator plunger 13*a*, the passage 15 is coupled through the internal passage 19*a* to the passage 15 to vent the line 23 to 40 psi pressure via the regulating valve 101** which is of the self-relieving type. The 40 psi pressure is then maintained in the carbonator during the dispensing cycle.

Also shown in the embodiment of FIG. 3 is an inlet 43 for carbonated water and an outlet line 45. A third passage 47 in the push-button actuator **13*a* couples passages 43 and 45 when the plunger 13 is in the unoperated position, i.e., bias upward by spring 41***a*. This insures that during the admission of the high pressure gas to the carbonator, the higher pressure is not fed back through the system to the manifold and dispensing valve which may not be designed to withstand this type of pressure.

What is claimed is:

1. In a drink dispenser for dispensing carbonated drinks which includes a source of carbon dioxide at high pressure and a source of carbon dioxide at a lower pressure, said lower pressure being a pressure utilized for dispensing carbonated water, a method of quickly batch carbonating water within a carbonator tank having a head space comprising the steps of:

(a) admitting carbon dioxide to the carbonator tank at said higher pressure until a pressure intermediate said higher and lower pressure is reached in said head space; and (b) venting the head space of the carbonator to said lower pressure.

2. The method according to claim 1, and further including repeating steps (a) and (b) of claim 1 a plurality of times.

3. The method according to claim 1, wherein said higher pressure is on the order of 800 to 1200 psi pounds per square inch, said lower pressure approximately 40 pounds per square inch and said intermediate pressure approximately 175 pounds per square inch.

4. In a drink dispenser for dispensing carbonated drinks including a batch carbonator with a sparger through which carbon dioxide may be admitted for carbonating still water within the carbonator, a head space being provided over the water in the carbonator, said system including a source of high pressure carbon dioxide and a source of lower pressure carbon dioxide, a carbonating valve comprising:

(a) means, for coupling the higher pressure carbon dioxide to the sparger upon actuation of said valve;

(b) a pressure relief valve set to operate at a pressure intermediate said higher and lower pressures coupled to the head space of said carbonator; and (c) means to couple said head space to said lower pressure when said carbonating valve is returned to an unactuated position after operation of said pressure relief valve thereof, whereby said head space will be vented to said lower pressure.

5. Apparatus according to claim 4, and further including means for interrupting a carbonated water connection between said carbonator and dispensing means when said carbonating valve is operated thereby preventing said higher pressure from reaching said dispensing means.

6. Apparatus according to claim 4, wherein said carbonating valve comprises:

(a) a valve body having formed therein a first inlet for coupling to said higher pressure, a second inlet for coupling to said lower pressure, a third inlet for coupling to said head space, and an outlet for coupling to said sparger; and (b) a valving member containing therein first and second passages, said first passage coupling said first inlet and said outlet when said carbonating valve is operated and said second passage coupling said second and third inlets when said carbonating valve is in an unoperated position.

7. Apparatus according to claim 6, wherein said carbonating valve member comprises a plunger and further including a spring biasing said plunger to the unoperated position.

8. Apparatus according to claim 6, wherein said relief valve is located in said valve body coupled to said third inlet.

9. Apparatus according to claim 6, wherein said relief valve is in said plunger coupled to said second passageway and wherein said passageway is adapted to be coupled to said third inlet at all times.

10. Apparatus according to claim 6, and further including a carbonated water inlet in said valve body and a carbonated water outlet in said valve body and further including a third passage in said plunger, said third passage adapted to couple said carbonated water inlet and outlet when said carbonating valve is in an unoperated position.

* * * * *